US005772473A

United States Patent [19]

Cheng et al.

[11] Patent Number: 5,772,473

[45] Date of Patent: Jun. 30, 1998

[54] FUSE HOLDER

[76] Inventors: Wen-Tzung Cheng, No. 422, Fu-Hsing Rd.; Wen-Huoh Cheng, No. 424, Fu-Hsing Rd., both of Tao Yuan City, Tao Yuan Hsien, Taiwan

[21] Appl. No.: 778,029

[22] Filed: Jan. 2, 1997

[51] Int. Cl.[6] ..... H01R 13/66

[52] U.S. Cl. ..... 439/621; 439/805

[58] Field of Search ..... 439/621, 622, 439/623, 805; 361/833

[56] References Cited

U.S. PATENT DOCUMENTS 5,018,991 5/1991 Katz et al. ..... 437/621

5,573,423 11/1996 Lin et al. ..... 439/805

*Primary Examiner*—Neil Abrams

*Assistant Examiner*—Katrina Davis

*Attorney, Agent, or Firm*—Merchant, Gould, Smith, Edell, Welter & Schmidt

[57] ABSTRACT

A fuse holder including a shell, two jacks mounted inside the shell at two opposite ends and respectively connected to the conductors of two electric wires, and a cartridge fuse mounted inside the shell and connected between the jacks, wherein each jack includes a first connector disposed at an inner side, a second connector disposed at an outer side, and a clamp connected between the first connector and the second connector, the first connector being a stepped, cylindrical element having a center through hole, which receives one electric wire, an embossed outside wall, and a screw rod at an inner end, the second connector having an inner thread at one end threaded onto the screw rod of the first connector, and an expanded split coupling portion at an opposite end plugged onto one end of the cartridge fuse, the clamp being connected between the first connector and the second connector and mounted around one electric wire, permitting the conductor of the corresponding electric wire to be firmly retained between the outside wall of the clamp and the inside wall of the second connector.

4 Claims, 7 Drawing Sheets

FUSE HOLDER

BACKGROUND OF THE INVENTION

The present invention relates to a fuse holder adapted for holding two electric wires and a cartridge fuse, permitting the cartridge fuse to be connected between the electric wires, and more particularly to such a fuse holder which can be conveniently installed without the use of any external fastening elements.

FIG. 1 shows a fuse holder according to the prior art. This structure of fuse holder comprises a shell 10*a*, two jacks 11*a* respectively mounted in the shell 10*a* at two opposite ends and having a respective fuse holding hole 12*a* at an inner side and a respective plug hole 14*a* at an outer side, and a cartridge fuse 13*a* having two opposite ends respectively plugged into the fuse holding holes 12*a* of the jacks 11*a*. When the conductors of two electric wires are respectively inserted into the plug holes 14*a* of the jacks 11*a*, holding down screws 15*a* are respectively threaded into a respective radial screw hole at each end of the shell 10*a* to hold down the electric wires. Because holding down screws 15*a* are used and installed to hold down the electric wires, a screwdriver shall be used during the installation of the fuse holder.

SUMMARY OF THE INVENTION

The present invention provides a fuse holder which can be conveniently installed without the use of any external fastening elements or hand tools. According to the present invention, the jacks which are connected between the electric wires and the cartridge fuse, comprise each a first connector disposed at an inner side, a second connector disposed at an outer side, and a clamp connected between the first connector and the second connector. The first connector is a stepped, cylindrical element having a center through hole, which receives one electric wire, an embossed outside wall, and a screw rod at an inner end. The second connector comprises an inner thread at one end threaded onto the screw rod of the first connector, and an expanded split coupling portion at an opposite end plugged onto one end of the cartridge fuse. The clamp is connected between the first connector and the second connector and mounted around one electric wire, permitting the conductor of the corresponding electric wire to be firmly retained between the outside wall of the clamp and the inside wall of the second connector.

DETAILED DESCRIPTION OF THE PREFERRED EMBODIMENT

Figure 1:
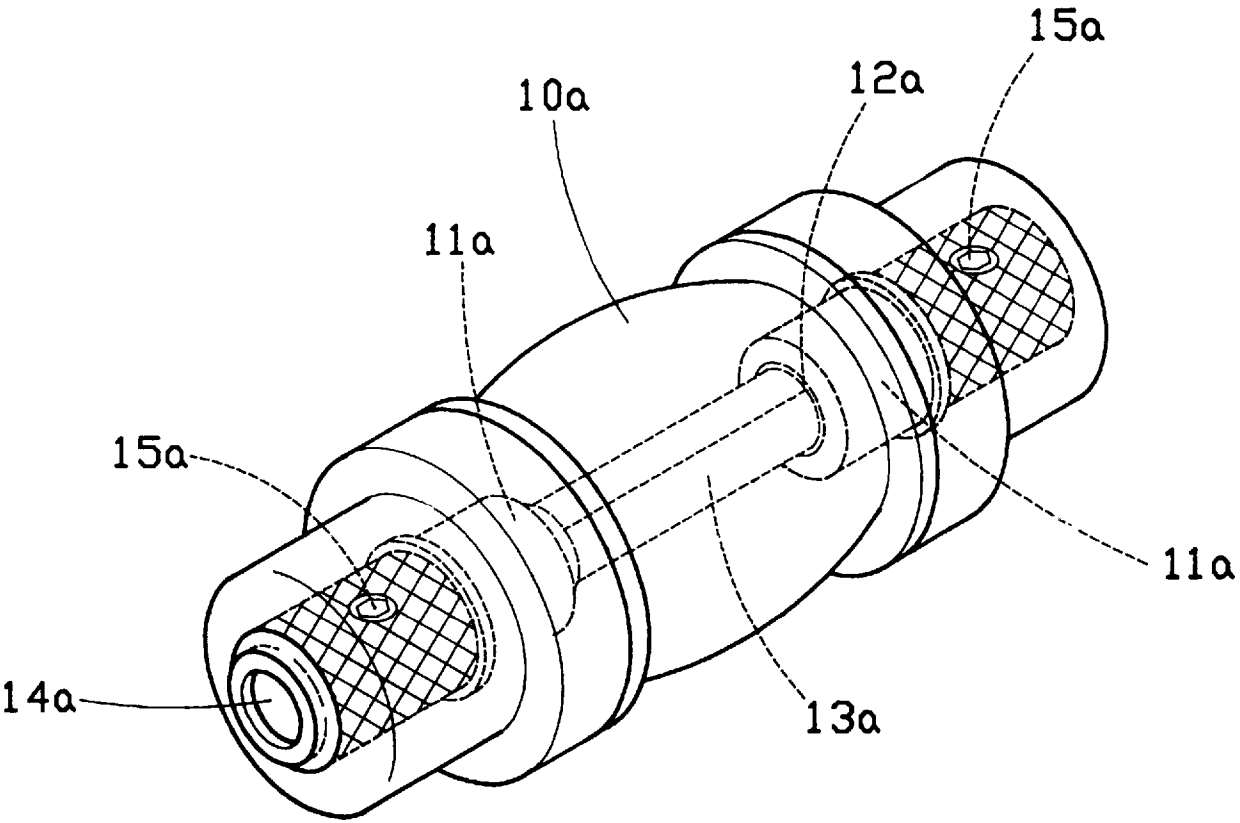
FIG. 1 PRIOR ART
FIG. 1 is a perspective view of a fuse holder according to the prior art.
Figure 2:
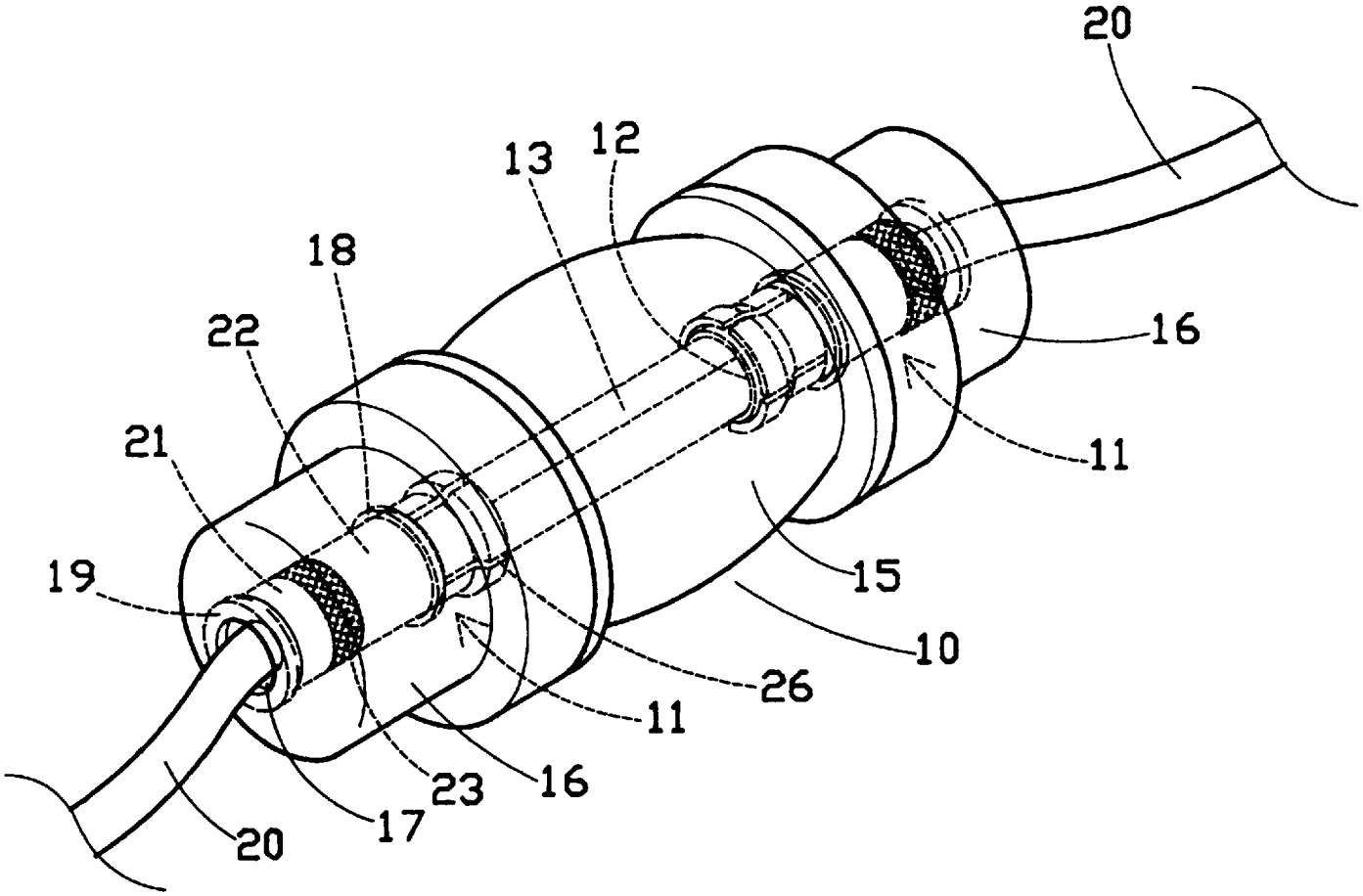
FIG. 2 is a perspective view of a fuse holder according to the present invention.
Figure 3:
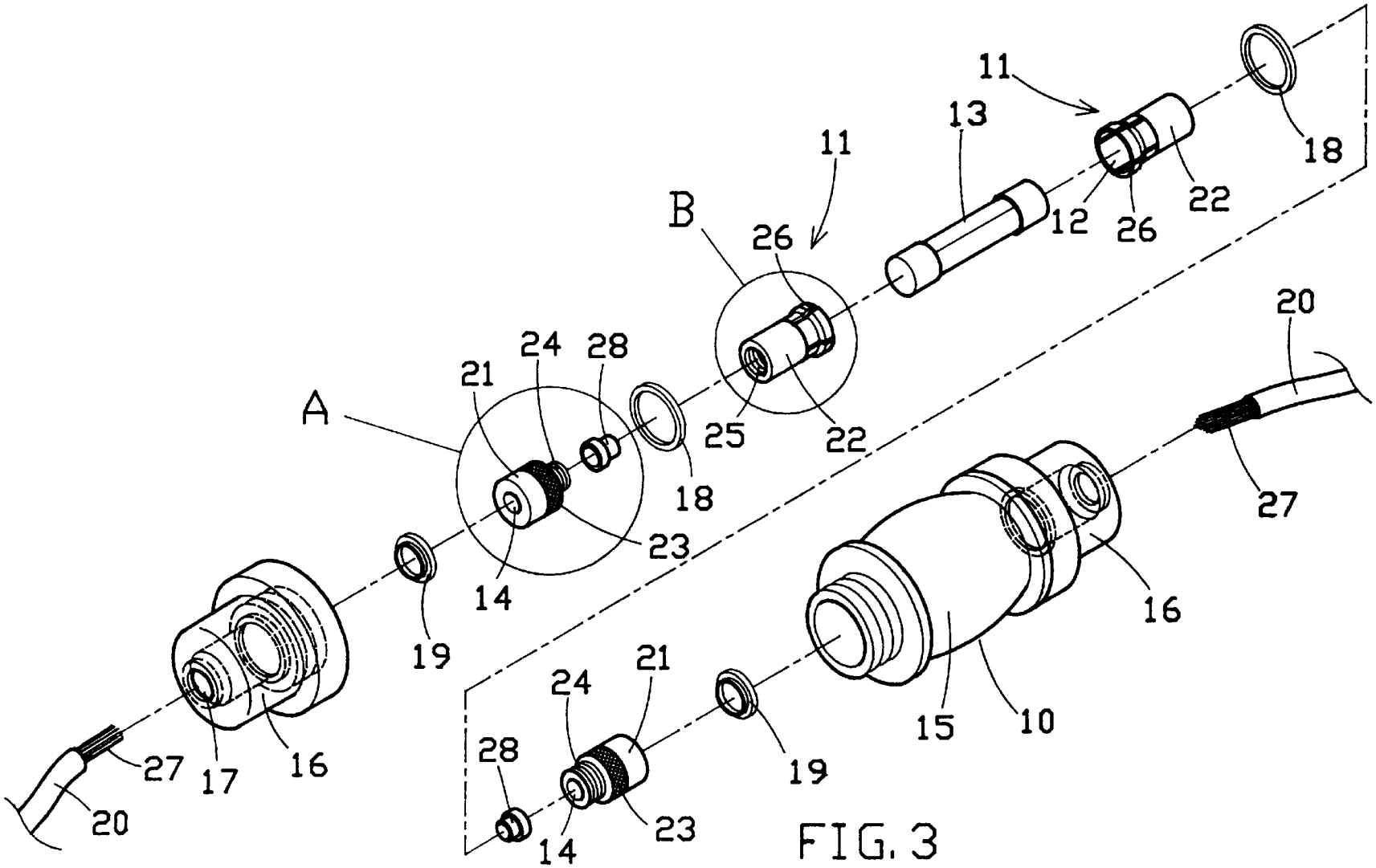
FIG. 3 is an exploded view of the fuse holder shown in FIG. 2.
Figure 4:
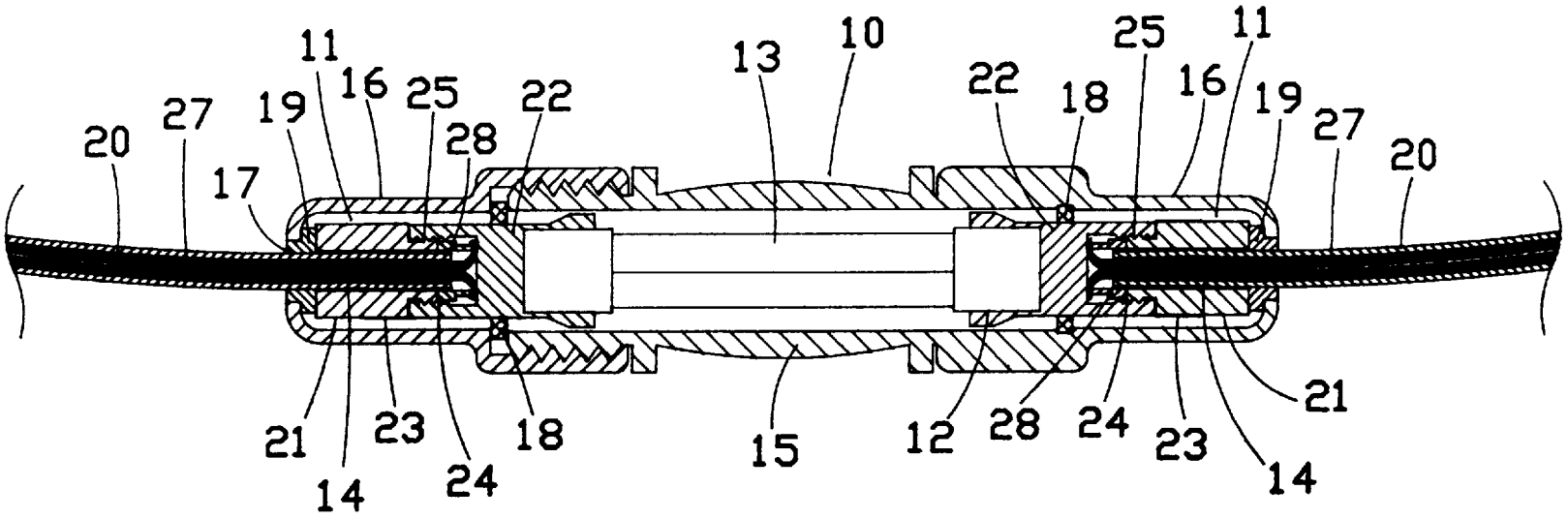
FIG. 4 is a sectional view of the present invention, showing the fuse holder installed.

Referring to FIGS. 2, 3 and 4, a fuse holder in accordance with the present invention is generally comprised of an electrically insulative transparent shell 10, two jacks 11 mounted inside the transparent shell 10 at two opposite ends and respectively connected to two electric wires 20, and a cartridge fuse 13 mounted inside the transparent shell 10 and connected between the jacks 11.

Referring to FIG. 3 again, the transparent shell 10 is comprised of a shell body 15 having two opposite ends externally threaded, and two end caps 16 threaded onto two opposite ends of the shell body 15. Each end cap 16 has a center through hole 17 through which one electric wire 20 passes.

Figure 3B:
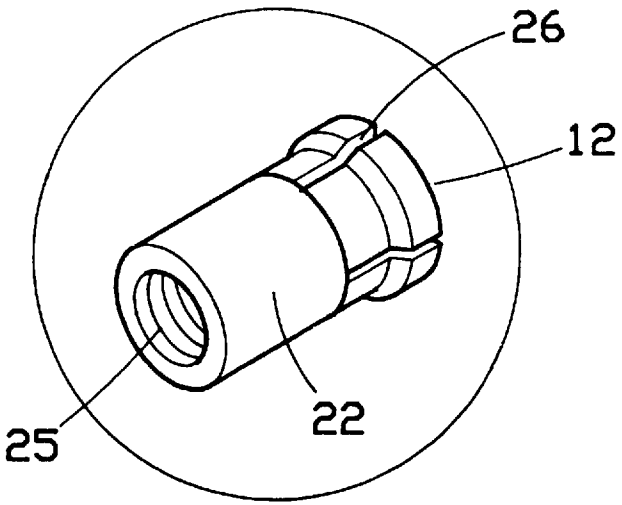
FIG. 3B is an enlarged view of part B of FIG. 3.
Figure 3A:
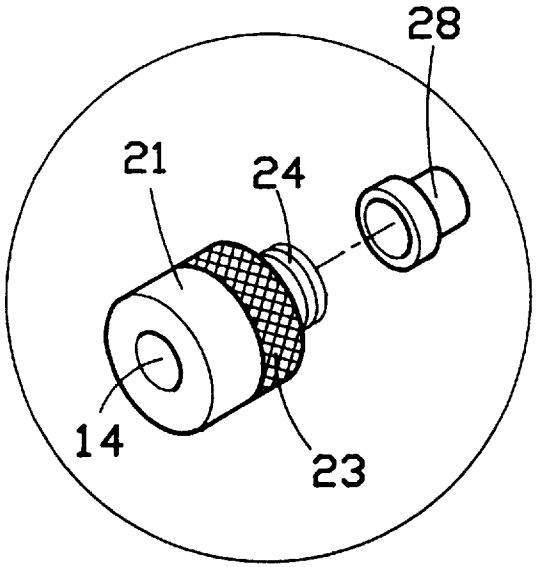
FIG. 3A is an enlarged view of part A of FIG. 3.

Referring to FIGS. 3A, 3B and 4 again, each jack 11 is comprised of a first connector 21 disposed at an inner side, a second connector 22 disposed at an outer side, and a clamp 28. The first connector 21 is a stepped, cylindrical element having a center through hole 14, which receives one electric wire 20, an embossed outside wall 23, and a screw rod 24 at an inner end. T he second connector 22 comprises an inner thread 25 at one end, and an expanded split coupling portion 26 at an opposite end defining a holding hole 12 adapted for holding one end of the cartridge fuse 13. The clamp 28 is connected between the first connector 21 and the second connector 22 to hold down one electric wire 20.

The installation procedure of the fuse holder is outlined hereinafter with reference to FIGS. 3 and 4, the electric wires 20 are respectively inserted through the center through holes 17 of the end caps 16 of the shell 10 and the center through holes 14 of the first connectors 21 of the jacks 11, permitting the conductors (stranded wires) 27 of the electric wires 20 to be respectively bent backwards and attached to the outside of the clamps 28, then the screw rods 24 of the first connectors 21 are respectively threaded into the inner threads 25 of the second connectors 22 (through the embossed outside wall 23, the first connector 21 can be positively held with fingers and turned), permitting the folded up conductors (stranded wires) 27 of the electric wires 20 to be respectively and fixedly secured between the outside wall of the clamps 28 and the inside wall of the second connectors 22, and then the two opposite ends (terminals) of the cartridge fuse 13 are respectively plugged into the holding holes 12 of the second connectors 22 and received inside the body 15 of the transparent shell 10, and then the end caps 16 are respectively threaded onto the two opposite threaded ends of the shell body 15 to hold the jacks 11 and the cartridge fuse 13 inside the shell body 15 of the transparent shell 10. Furthermore, first rubber seal rings 19 may be respectively mounted around the electric wires 20 and scaled within the center through holes 17 of the end caps 16, and second rubber seal rings 18 may be respectively mounted around the threaded two opposite ends of the shell body 15 and sealed within the end caps 16.

Figure 5:
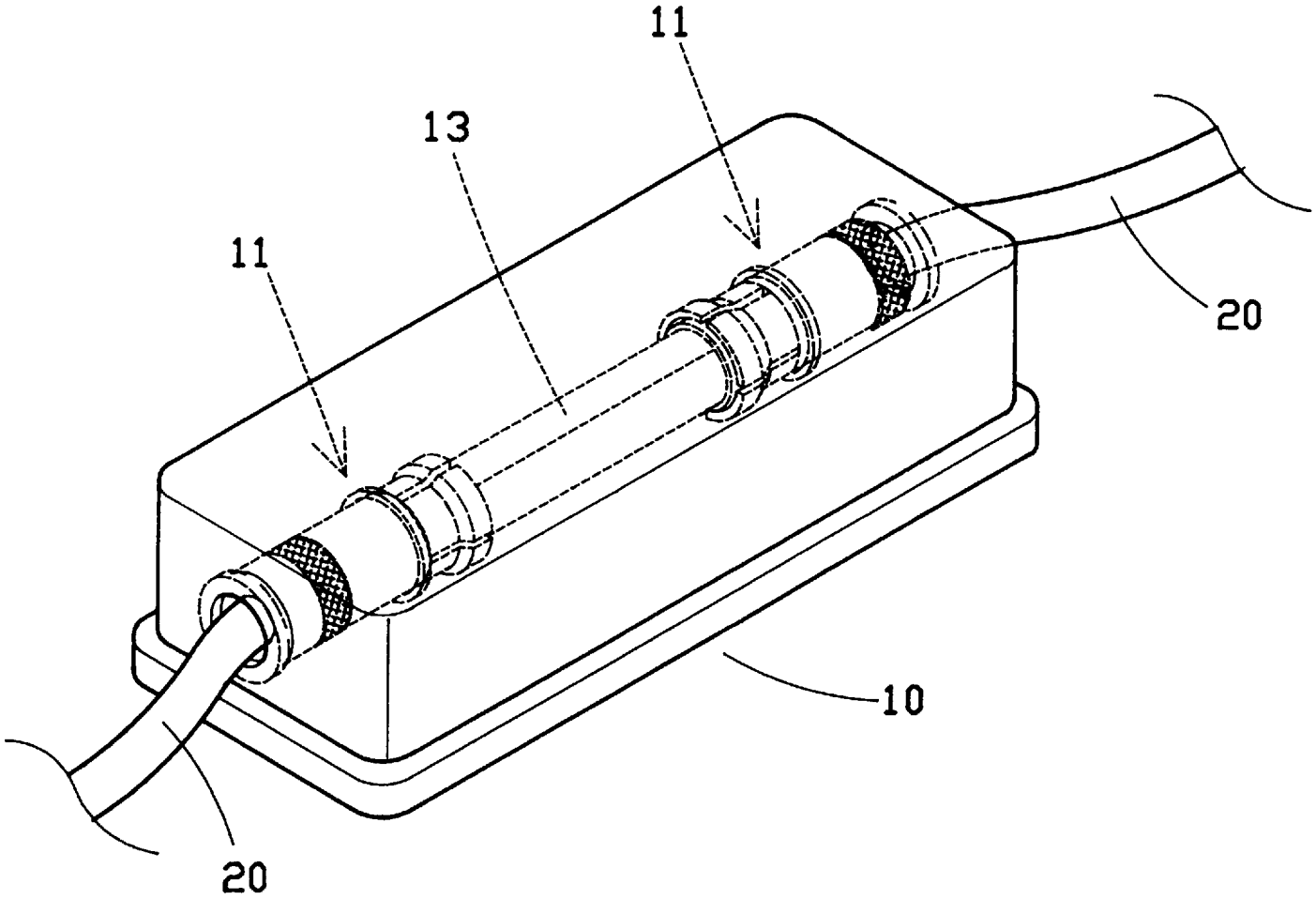
FIG. 5 shows an alternate form of the present invention.
Figure 6:
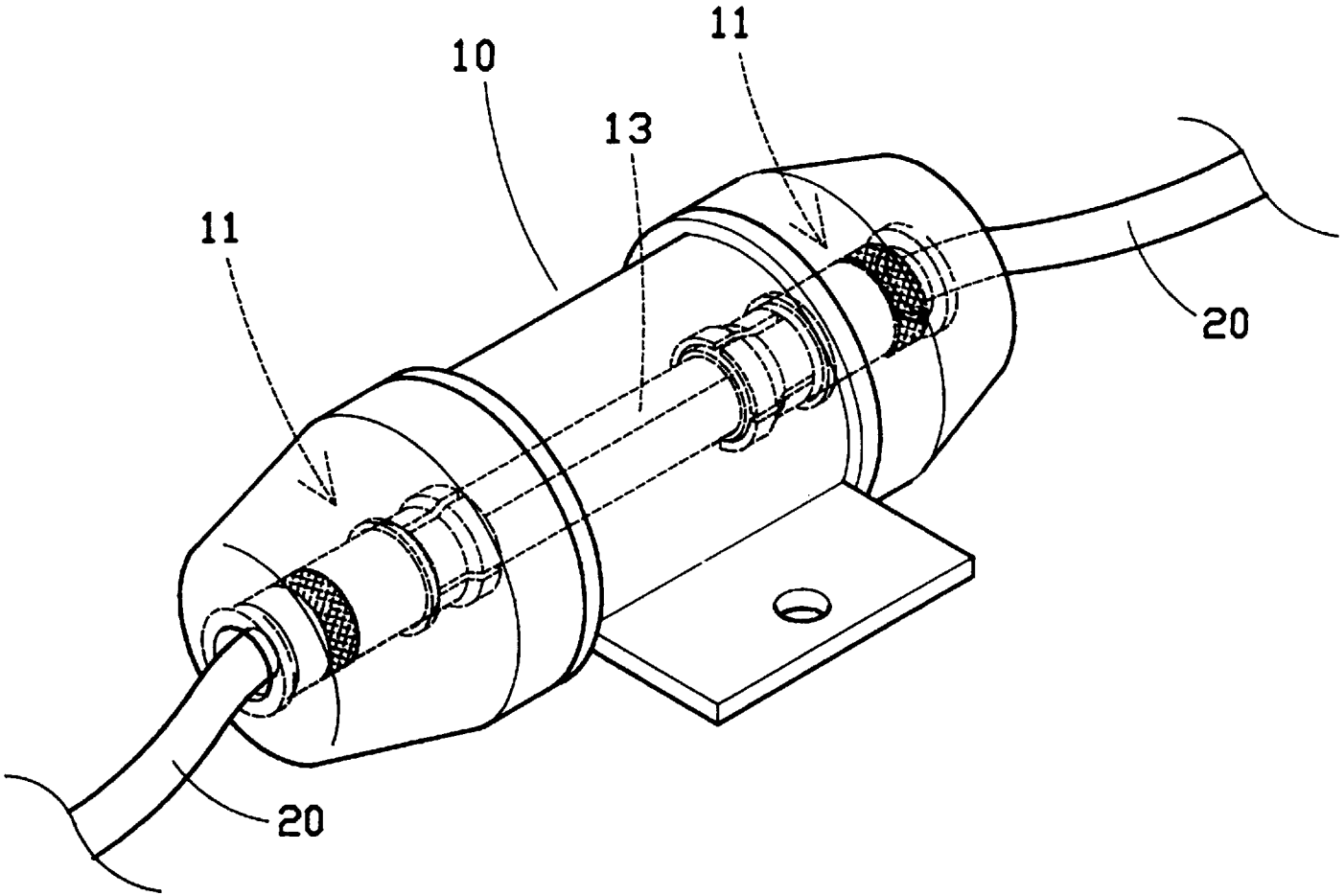
FIG. 6 shows another alternate form of the present invention.

Referring to FIGS. 5 and 6, the transparent shell 10 may be variously embodied. In FIG. 5, the transparent shell 10 is made in the form of a rectangular case. In FIG. 6, the transparent shell 10 has a mounting plate at one side convenient for mounting.

It is to be understood that the drawings designed are for purposes of illustration only, and are not intended as a definition of the limits and scope of the invention disclosed.

What the invention claimed is:

1. A fuse holder comprising an electrically insulative transparent shell, two jacks mounted inside said transparent shell at two opposite ends and respectively connected to conductors of two electric wires, and a cartridge fuse mounted inside said transparent shell and connected between said jacks, wherein:

each of said jacks is comprised of a first connector disposed at an inner side, a second connector disposed at an outer side, and a clamp connected between said first connector and said second connector, said first connector being a stepped, cylindrical element having a center through hole, which receives one electric wire, an embossed outside wall, and a screw rod at an inner end, said second connector comprising an inner thread at one end threaded onto the screw rod of said first connector, and an expanded split coupling portion at an opposite end plugged onto one end of said cartridge fuse, said clamp being connected between said first connector and said second connector and mounted around one electric wire, permitting the conductor of the corresponding electric wire to be firmly retained between an outside wall of said clamp and an inside wall of said second connector.

2. The fuse holder of claim 1 wherein said transparent shell is comprised of a hollow shell body having two opposite ends externally threaded, and two end caps respectively threaded onto the two externally threaded opposite ends of said shell body, each of said end caps having a center through hole through which one electric wire passes.

3. The fuse holder of claim 2 further comprising two rubber seal rings respectively mounted around the two externally threaded opposite ends of said shell body and sealed within said end caps.

4. The fuse holder of claim 2 further comprising two rubber seal rings respectively mounted around said two electric wires and sealed within the center through holes of the end caps of said transparent shell.

* * * * *